US010380990B2

(12) United States Patent
Sweet et al.

(10) Patent No.: US 10,380,990 B2
(45) Date of Patent: Aug. 13, 2019

(54) ACTIVE NOISE CONTROL SIMULATED NOISE AUDIO OUTPUT FOR ACTIVE NOISE CONTROL TESTING

(71) Applicant: Panasonic Automotive Systems Company of America, Division of Panasonic Corporation of North America, Peachtree City, GA (US)

(72) Inventors: Benjamin David Sweet, West Bloomfield, MI (US); Richard Lawrence Cooper, Newnan, GA (US)

(73) Assignee: Panasonic Automotive Systems Company of America, Division of Panasonic Corporation of North America, Peachtree City, GA (US)

( * ) Notice: Subject to any disclaimer, the term of this patent is extended or adjusted under 35 U.S.C. 154(b) by 0 days.

(21) Appl. No.: 16/136,380

(22) Filed: Sep. 20, 2018

(65) Prior Publication Data

US 2019/0019492 A1 Jan. 17, 2019

Related U.S. Application Data

(63) Continuation of application No. 15/423,995, filed on Feb. 3, 2017, now Pat. No. 10,147,412.
(Continued)

(51) Int. Cl.
*G10K 11/178* (2006.01)

(52) U.S. Cl.
CPC ..... *G10K 11/178* (2013.01); *G10K 11/17883* (2018.01); *G10K 2210/1282* (2013.01);
(Continued)

(58) Field of Classification Search
CPC ..... G10K 11/178; G10K 11/1788; G10K 11/17883; G10K 2210/1282;
(Continued)

(56) References Cited

U.S. PATENT DOCUMENTS

2010/0290635 A1* 11/2010 Shridhar ..... G10K 11/178 381/71.1
2011/0064232 A1* 3/2011 Ruwisch ..... H04M 1/24 381/59
2014/0079243 A1* 3/2014 Appell ..... H03G 3/32 381/86

OTHER PUBLICATIONS

Microchip, Atmel Studio 7, Website: https://www.microchip.com/mplab/avr-support/atmel-studio-7.

* cited by examiner

*Primary Examiner* — Yogeshkumar Patel
(74) *Attorney, Agent, or Firm* — Laurence S. Roach, Esq.

(57) ABSTRACT

A vehicle includes an engine and/or powertrain producing noise that is audible in a passenger compartment of the vehicle when the engine and/or powertrain is running. An active noise control arrangement includes a first loudspeaker disposed within a passenger compartment of the vehicle. A digital signal processor receives audio data and transmits an audio signal to the first loudspeaker dependent upon the audio data. A microphone is disposed within the passenger compartment and converts the sound from the first loudspeaker and the noise within the passenger compartment into a microphone signal. The microphone signal is transmitted to the digital signal processor, and the digital signal processor modifies the audio signal such that the audio signal attenuates the noise in the passenger compartment. A vehicle processor transmits a simulated noise signal to a second loudspeaker for use in testing effectiveness of the active noise control arrangement in attenuating noise when the engine and/or powertrain is not running and not producing noise.

20 Claims, 2 Drawing Sheets

Related U.S. Application Data

(60) Provisional application No. 62/290,980, filed on Feb. 4, 2016.

(52) U.S. Cl.
CPC ..... *G10K 2210/3026* (2013.01); *G10K 2210/3027* (2013.01); *G10K 2210/3052* (2013.01); *G10K 2210/3057* (2013.01); *G10K 2210/504* (2013.01)

(58) Field of Classification Search
CPC ... G10K 2210/3026; G10K 2210/3027; G10K 2210/504; G10K 2210/3052; G10K 2210/3057; G10K 2210/3048
USPC ..... 381/71.4, 58, 59, 61, 86, 92
See application file for complete search history.

ACTIVE NOISE CONTROL SIMULATED NOISE AUDIO OUTPUT FOR ACTIVE NOISE CONTROL TESTING

CROSS-REFERENCED TO RELATED APPLICATIONS

This application is a continuation of U.S. patent application Ser. No. 15/423995, filed on Feb. 3, 2017, which is currently under allowance, which claims benefit of U.S. Provisional Application No. 62/290,980 filed on Feb. 4, 2016, which the disclosure of which are hereby incorporated by reference in their entirety for all purposes.

FIELD OF THE INVENTION

The disclosure relates to the field of active noise control (ANC) systems, and, more particularly, to active noise control systems on a vehicle.

BACKGROUND OF THE INVENTION

Known ANC systems typically handle only the cancellation of the "noise" signal. These systems may have no capability to perform testing with a "simulated noise" output.

In order to test the operation of the ANC system, a "noise" signal is necessary for the ANC system to cancel and/or attenuate. Testing the system in a normally operating vehicle environment may be problematic in that the exact "noise" output from the vehicle system may be difficult to exactly control, and specific test scenarios may be difficult or impossible to reproduce exactly.

Producing a "simulated noise" output using external equipment (such as a waveform generator) might be problematic in configuring the equipment to interpret (e.g., decode a controller area network (CAN) message, or process timed pulses) the dynamic vehicle operational parameter information (which may include but is not limited to: engine speed, driveshaft speed, transmission load torque) to produce the desired waveform frequency. Also, additional, and possibly expensive, lab equipment (e.g., a waveform generator) will be necessary to produce the waveform.

SUMMARY

The present invention may provide an active noise control (ANC) system that monitors specific ranges of audio content in the vehicle interior environment deemed to be "noise", and produces an audio output to cancel (or attenuate the amplitude) of the "noise" heard by passengers in the vehicle. The expected range of noise frequencies is dependent on the engine speed, which can be expressed in revolutions per minute (RPM), as audio components of the noise are related to the frequency of combustion events in the engine, as well as other dynamic vehicle operational parameters.

This invention may use the dynamic vehicle operational parameter information to produce a "simulated noise" audio output to simulate the expected noise for the given dynamic vehicle operational parameter values. This provides an audio output for the ANC system to monitor and cancel/attenuate.

The dynamic vehicle operational parameter values can be provided by various sources (e.g., controller area network (CAN) message(s), timed pulses), and might be simulated by various means other than the actual vehicle systems that normally produce these signals during vehicle operation. Thus, the "simulated noise" output may be generated based on simulated dynamic vehicle operational parameter data even if the vehicle engine is not running.

According to the invention, the same subsystem that monitors dynamic vehicle operational parameters (from whatever source, such as a CAN message, timed pulses, etc.) and provides the data to the ANC digital signal processor may also produce an analog waveform. An additional audio output circuit consisting of a few passive components and possibly a signal buffering amplifier might be employed. This audio output can then be routed to an external power amplifier to drive an audio actuator (e.g., a sub-woofer). Placing the audio actuator inside the vehicle compartment (or other strategic placement of the audio actuator) can be used to simulate the "noise" audio that would be produced by an actual engine/powertrain operating at the given engine speed.

This "simulated noise" audio output can be used to test the ANC system operation in a vehicle environment without actually running the engine of the vehicle. Externally controlled dynamic vehicle operational parameter values (and profiles of varying values) can be precisely controlled by standard lab equipment. This significantly facilitates the testing and evaluation of ANC systems in the vehicle, creating reproducible data with a minimum of specialized lab equipment.

In one embodiment, the invention comprises a vehicle including an engine and/or powertrain producing noise that is audible in a passenger compartment of the vehicle when the engine and/or powertrain is running. An active noise control arrangement includes a first loudspeaker disposed within a passenger compartment of the vehicle. A digital signal processor receives audio data and transmits an audio signal to the first loudspeaker dependent upon the audio data. A microphone is disposed within the passenger compartment and converts the sound from the first loudspeaker and the noise within the passenger compartment into a microphone signal. The microphone signal is transmitted to the digital signal processor, and the digital signal processor modifies the audio signal such that the audio signal attenuates the noise in the passenger compartment. A vehicle processor transmits a simulated noise signal to a second loudspeaker for use in testing effectiveness of the active noise control arrangement in attenuating noise when the engine and/or powertrain is not running and not producing noise.

In another embodiment, the invention comprises a vehicle including an engine and/or powertrain producing noise that is audible in a passenger compartment of the vehicle when the engine and/or powertrain is running. An active noise control arrangement includes a first loudspeaker disposed within a passenger compartment of the vehicle. A processing device receives the audio content and transmits an audio signal to the first loudspeaker dependent upon the audio content. A microphone disposed within the passenger compartment converts the sound from the first loudspeaker and the noise within the passenger compartment into a microphone signal. The microphone signal is transmitted to the processing device, which modifies the audio signal such that the audio signal attenuates the noise in the passenger compartment. A vehicle processor receives real time dynamic vehicle operational parameter data while the engine is running. The dynamic vehicle operational parameter data is indicative of actual vehicle operating conditions (such as rotational speed of the engine) that are current when the data is created. The vehicle processor transmits a simulated noise signal to a second loudspeaker for use in testing effectiveness of the active noise control arrangement in attenuating noise when the engine and/or powertrain is not running and not producing noise. The simulated noise signal is dependent upon the dynamic vehicle operational parameter data.

In yet another embodiment, the invention comprises a vehicle including an engine and/or powertrain producing noise that is audible in the passenger compartment when the engine and/or powertrain is running. An active noise control arrangement includes a first loudspeaker disposed within a passenger compartment of the vehicle. A processing device receives audio content and transmits an audio signal to the first loudspeaker dependent upon the audio content. A microphone is disposed within the passenger compartment and converts the sound from the first loudspeaker and the noise within the passenger compartment into a microphone signal. The microphone signal is transmitted to the processing device, which modifies the audio signal such that the audio signal attenuates the noise in the passenger compartment. A vehicle processor receives an external signal from a source external to the vehicle engine. The external signal is related to dynamic vehicle operational parameter values. A simulated noise signal is transmitted to the second loudspeaker for use in testing effectiveness of the active noise control arrangement in attenuating noise when the engine and/or powertrain is not running and not producing noise. The simulated noise signal is dependent upon the external signal.

The present invention has the advantage that the ANC system may output an audio tone simulating engine noise for in-vehicle testing.

BRIEF DESCRIPTION OF THE DRAWINGS

A better understanding of the present invention will be had upon reference to the following description in conjunction with the accompanying drawings.

An advantage of the present invention is that expensive equipment such as a waveform generator does not need to be procured and added to in order to produce a simulated engine noise waveform.

DETAILED DESCRIPTION OF THE PREFERRED EMBODIMENTS

Figure 1:
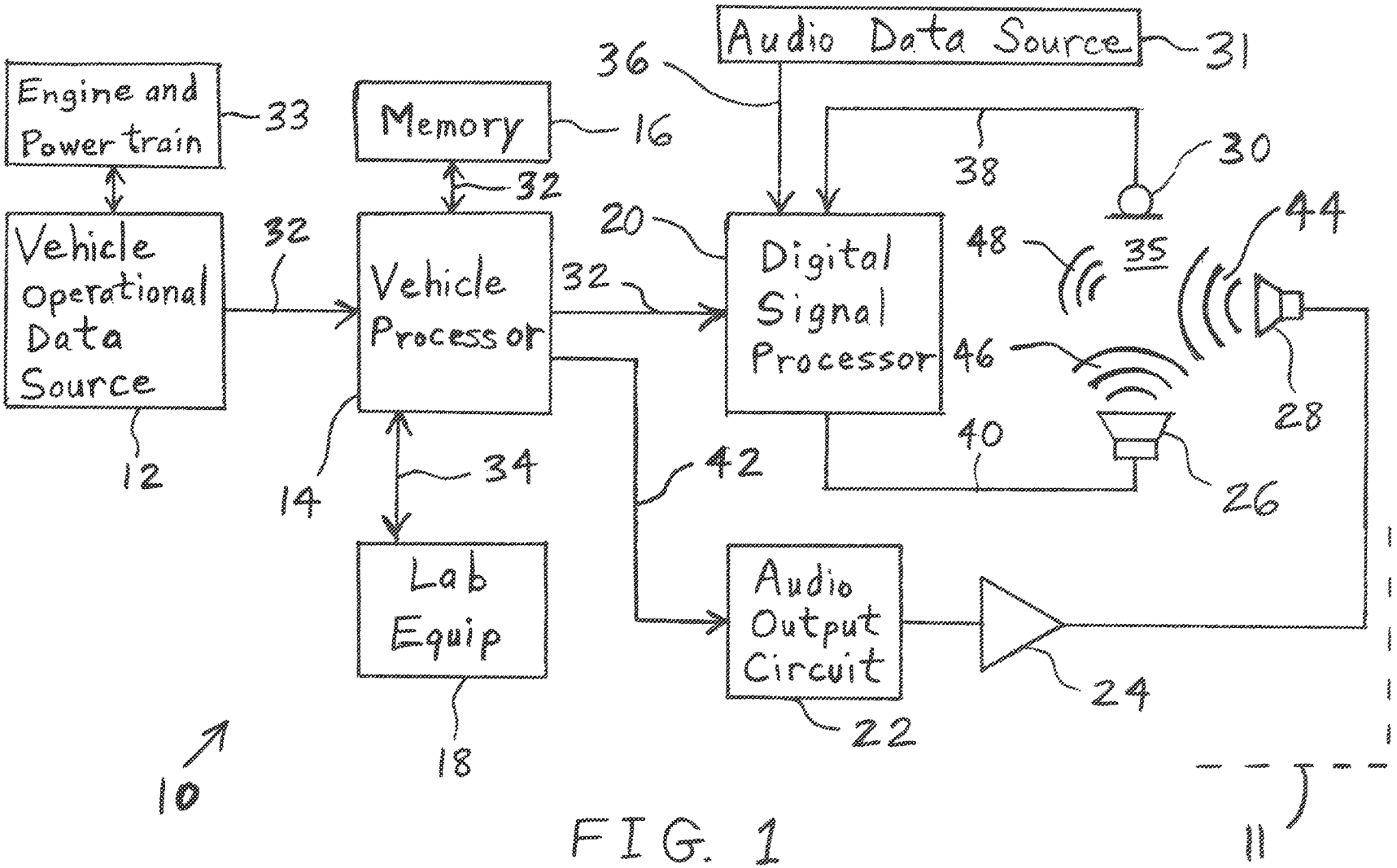
FIG. 1 is a block diagram of one embodiment of an active noise control simulated noise arrangement of the present invention.

FIG. 1 illustrates one embodiment of an active noise control simulated noise arrangement 10 of the present invention located in a motor vehicle 11. Arrangement 10 may include a vehicle operational data source 12, a vehicle processor 14, a memory device 16, laboratory equipment 18, a digital signal processor (DSP) 20, an audio output circuit 22, an amplifier 24, loudspeakers 26, 28, a microphone 30, and a source of audio data 31.

Vehicle operational data source 12 may produce vehicle operational data 32, such as dynamic vehicle operational parameter data (such as, but not limited to, engine speed) or timed pulses, for example. Vehicle operational data source 12 may be in the form of a controller area network (CAN) or a local interconnect network (LIN), for example. Vehicle operational data source 12 may be coupled to an engine and/or powertrain 33 which produces noise that is audible in a passenger compartment 35 of the motor vehicle when engine and/or powertrain 33 is running or operating.

Vehicle processor 14 receives vehicle operational data 32 and may store all or some of data 32 in memory device 16. Vehicle processor 14 may also transmit vehicle operational data 32 to DSP 20.

Laboratory equipment 18 may provide to vehicle processor 14 a signal 34 which may include dynamic vehicle operational parameter values and/or profiles of varying dynamic vehicle operational parameter values. These dynamic vehicle operational parameter values and/or profiles may be programmable by a user.

DSP 20 receives audio data 36, which typically may be music, from audio data source 31, which typically may be a radio, personal media device, or compact disc player, for example. DSP 20 may also receive an empirical audio signal 38 from microphone 30, which may be located in the passenger compartment of the vehicle. Thus, empirical audio signal 38 from microphone 30 may include both music played on loudspeaker 26 and actual or simulated engine noise as is audible in the passenger compartment of the vehicle.

During operation of the vehicle, DSP 20 may compare empirical audio signal 38 to audio data 36 to determine what periodic noise (e.g., engine noise or powertrain noise) may be present in the passenger compartment in addition to the music. For example, a difference between empirical audio signal 38 and audio data 36 may roughly represent the periodic noise that may be present in the passenger compartment. Vehicle operational data 32 may also be used by DSP 20 to identify the frequencies of the periodic noise.

DSP 20 may calculate and transmit an active noise control audio signal 40 to loudspeaker 26 that includes both audio data 36 and an active noise control component that is intended to cancel out the periodic noise present in the passenger compartment. Thus, the user/listener may hear only the music of audio data 36, and not the sources of periodic noise.

During testing of arrangement 10, however, the vehicle may not be running, and thus there may not be any sources of periodic noise to test the effectiveness of the active noise control or of the cancellation of the periodic noise. Thus, during testing, simulated periodic noise may be emitted by loudspeaker 28 in order to determine whether it is properly controlled or canceled by the output of loudspeaker 26. More particularly, vehicle processor 14 may transmit an analog simulated periodic noise signal 42 that may be representative of the noise typically produced by the vehicle engine and powertrain while the vehicle is running.

Simulated periodic noise signal 42 may be based on stored vehicle operational data 32 in memory device 16, and/or on dynamic vehicle operational parameter values 34 provided by laboratory equipment 18. For example, vehicle processor 14 may refer to the dynamic vehicle operational parameter data in memory 16 to create a periodic waveform that is typical of or representative of the periodic noise that would result from the dynamic vehicle operational parameter in the data. The simulated noise signal may be transmitted more than one minute (e.g., multiple days) after the receipt of the dynamic vehicle operational parameter data upon which the simulated noise signal is dependent. The simulated noise signal may be indicative of an estimated magnitude and frequency of noise in the passenger compartment that resulted from the operational conditions at the engine speeds in the dynamic vehicle operational parameter data.

Alternatively, simulated periodic noise signal 42 may be based on dynamic vehicle operational parameter values 34 from laboratory equipment 18 that are included in a profile of dynamic vehicle operational parameter values created by engineers to test the effectiveness of the active noise control or cancellation over a wide range of noise conditions. Laboratory equipment 18 may be disposed outside the vehicle, or even many miles from the vehicle. The simulated noise signal 42 may be transmitted more than one minute after the receipt of the dynamic vehicle operational parameter values 34 upon which the simulated noise signal 42 is dependent. Simulated noise signal 42 may be indicative of an estimated magnitude and frequency of noise in the passenger compartment that would result from the engine running at dynamic vehicle operational parameter values 34.

In one embodiment, simulated periodic noise signal 42 is based on actual dynamic vehicle operational parameter values 32 from data source 12 and on dynamic vehicle operational parameter values 34 provided by laboratory equipment 18. Laboratory equipment 18 may receive actual dynamic vehicle operational parameter values 32 and provide dynamic vehicle operational parameter values that are not present in actual dynamic vehicle operational parameter values 32 in order to create an improved or more comprehensive profile of testing dynamic vehicle operational parameter data.

Audio output circuit 22 and amplifier 24 may transform simulated periodic noise signal 42 to be in a form that is suitable for input to loudspeaker 28. Loudspeaker 28 then emits audible simulated noise into the passenger compartment, as indicated at 44.

The active noise control audio signal 40 emitted from loudspeaker 26, as indicated at 46, is intended to cancel or attenuate the noise emitted from loudspeaker 28, as indicated at 48. Microphone 30 detects the music signal from loudspeaker 26 as well as the attenuated signal 48 resulting from the cancellation of the noise from loudspeaker 44 by the noise control component of the output of loudspeaker 26. DSP 20 may then evaluate the effectiveness of the noise control based on the noise remaining in empirical audio signal 38. Similarly to how simulated periodic noise signal 42 is processed through audio output circuit 22 and amplifier 24, ANC audio signal 40 may be processed by an audio output circuit and amplifier before being emitted from loudspeaker 26.

Figure 2:
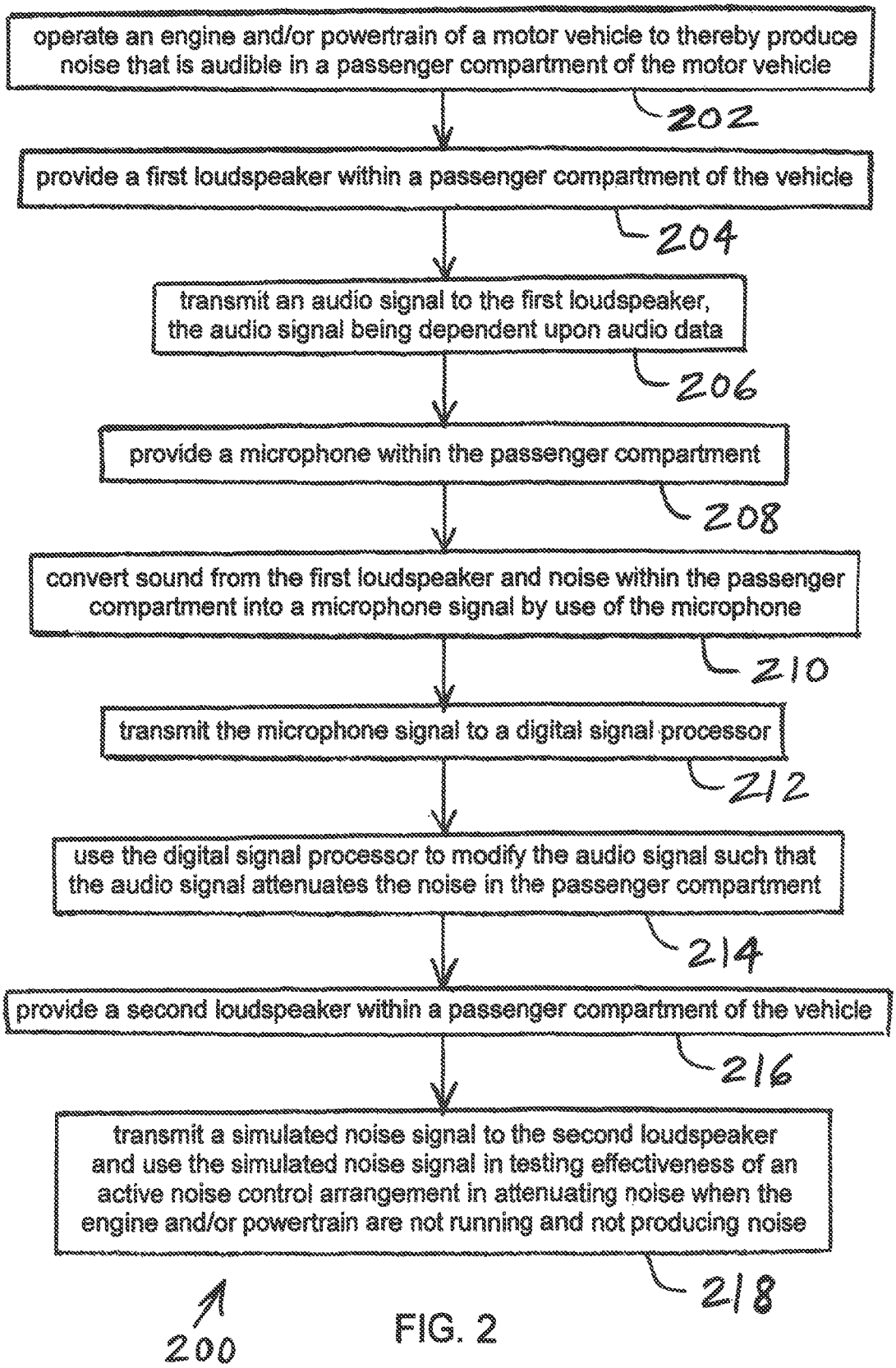
FIG. 2 is a flow chart of one embodiment of an active noise control testing method of the present invention.

FIG. 2 illustrates one embodiment of an active noise control testing method 200 of the present invention. In a first step 202, an engine and/or powertrain of a motor vehicle are operated to thereby produce noise that is audible in a passenger compartment of the motor vehicle. For example, engine and powertrain 33 of motor vehicle 11 may be operated to thereby produce noise that is audible in passenger compartment 35.

Next, in step 204 a first loudspeaker is provided within a passenger compartment of the vehicle. For example, loudspeaker 26 is provided within passenger compartment 35.

In a next step 206, an audio signal is transmitted to the first loudspeaker. The audio signal is dependent upon audio data. For example, DSP 20 may calculate and transmit an active noise control audio signal 40 to loudspeaker 26 that includes audio data 36.

In step 208, a microphone is provided within the passenger compartment. For example, microphone 30 is provided within passenger compartment 35.

Next, in step 210, sound from the first loudspeaker and noise within the passenger compartment are converted into a microphone signal by use of the microphone. For example, empirical audio signal 38 from microphone 30 may include both music played on loudspeaker 26 and actual or simulated engine noise as is audible in passenger compartment 35.

In a next step 212, the microphone signal is transmitted to a digital signal processor. For example, empirical audio signal 38 from microphone 30 may be transmitted to DSP 20.

In step 214, the digital signal processor is used to modify the audio signal such that the audio signal attenuates the noise in the passenger compartment. For example, DSP 20 may modify audio signal 36 to thereby produce an active noise control audio signal 40 which is emitted from loudspeaker 26. Active noise control audio signal 40 may attenuate the noise emitted from loudspeaker 28 in passenger compartment 35.

Next, in step 216, a second loudspeaker is provided within a passenger compartment of the vehicle. For example, loudspeaker 28 may be provided within passenger compartment 35.

In a next step 218, a simulated noise signal is transmitted to the second loudspeaker and is used in testing effectiveness of an active noise control arrangement in attenuating noise when the engine and/or powertrain are not running and not producing noise. For example, vehicle processor 14 may transmit an analog simulated periodic noise signal 42 to loudspeaker 28. DSP 20 may evaluate the effectiveness of the noise control of arrangement 10 based on the noise remaining in empirical audio signal 38, wherein empirical audio signal 38 results from use of analog simulated periodic noise signal 42 while engine and powertrain 33 are not running and are not producing noise.

The rotational speed of the engine referred to herein may refer to rotation of a portion of the engine and not to rotation of the entire engine itself. For example, the rotational speed of the engine may refer to the rotational speed of the crank shaft, cam shaft, or other rotating parts on the engine.

The foregoing description may refer to "motor vehicle", "automobile", "automotive", or similar expressions. It is to be understood that these terms are not intended to limit the invention to any particular type of transportation vehicle. Rather, the invention may be applied to any type of transportation vehicle whether traveling by air, water, or ground, such as airplanes, boats, etc.

The foregoing detailed description is given primarily for clearness of understanding and no unnecessary limitations are to be understood therefrom for modifications can be made by those skilled in the art upon reading this disclosure and may be made without departing from the spirit of the invention.

What is claimed is:

1. A vehicle comprising:

a passenger compartment;

an engine and/or powertrain producing noise that is audible in the passenger compartment when the engine and/or powertrain is running; and an active noise control arrangement, including:

a first loudspeaker disposed within a passenger compartment of the vehicle;

a digital signal processor configured to receive audio data and transmit an audio signal to the first loudspeaker dependent upon the audio data;

a microphone disposed within the passenger compartment and configured to:

convert the sound from the first loudspeaker and the noise within the passenger compartment into a microphone signal; and transmit the microphone signal to the digital signal processor, wherein the digital signal processor modifies the audio signal such that the audio signal attenuates the noise in the passenger compartment;

a second loudspeaker; and a vehicle processor configured to:

receive actual vehicle operational data; and transmit a simulated noise signal to the second loudspeaker for use in testing effectiveness of the active noise control arrangement in attenuating noise when the engine and/or powertrain is not running and not producing noise, the simulated noise signal being dependent upon the actual vehicle operational data.

2. The vehicle of claim 1 wherein the actual vehicle operational data comprises actual dynamic vehicle operational parameter data.

3. The vehicle of claim 1 wherein the vehicle processor stores the actual vehicle operational data in a memory device, the vehicle processor being configured to create the simulated noise signal based on the stored actual vehicle operational data while the engine is not running.

4. The vehicle of claim 1 wherein the digital signal processor is configured to receive the actual vehicle operational data and modify the audio signal dependent upon the actual vehicle operational data.

5. The vehicle of claim 1 wherein the digital signal processor is configured to receive the audio data from an audio source that is permanently installed in the vehicle.

6. The vehicle of claim 5 wherein the audio source comprises a radio or a compact disc player.

7. The vehicle of claim 1 wherein the digital signal processor is configured to receive the audio data from an audio source that is brought into the vehicle.

8. The vehicle of claim 7 wherein the audio source comprises a personal media device.

9. A vehicle comprising:

a passenger compartment;

an engine and/or powertrain producing noise that is audible in the passenger compartment when the engine and/or powertrain is running; and an active noise control arrangement, including:

a first loudspeaker disposed within a passenger compartment of the vehicle;

a processing device configured to receive audio content and transmit an audio signal to the first loudspeaker dependent upon the audio content;

a microphone disposed within the passenger compartment and configured to:

convert the sound from the first loudspeaker and the noise within the passenger compartment into a microphone signal; and transmit the microphone signal to the processing device, wherein the processing device modifies the audio signal such that the audio signal attenuates the noise in the passenger compartment;

a second loudspeaker; and a vehicle processor configured to:

receive real time dynamic vehicle operational parameter data while the engine is running, the received dynamic vehicle operational parameter data being indicative of a current operating condition of the engine; and transmit a simulated noise signal to the second loudspeaker for use in testing effectiveness of the active noise control arrangement in attenuating noise when the engine and/or powertrain is not running and not producing noise, the simulated noise signal being dependent upon the dynamic vehicle operational parameter data.

10. The vehicle of claim 9 wherein the processing device is configured to receive the dynamic vehicle operational parameter data and modify the audio signal dependent upon the dynamic vehicle operational parameter data.

11. The vehicle of claim 9 wherein the processing device is configured to receive the audio data from an audio source that is permanently installed in the vehicle.

12. The vehicle of claim 11 wherein the audio source comprises a radio or a compact disc player.

13. The vehicle of claim 9 wherein the processing device is configured to receive the audio data from an audio source that is brought into the vehicle.

14. The vehicle of claim 13 wherein the audio source comprises a personal media device.

15. A vehicle comprising:

a passenger compartment;

an engine and/or powertrain producing noise that is audible in the passenger compartment when the engine and/or powertrain is running; and an active noise control arrangement, including:

a first loudspeaker disposed within a passenger compartment of the vehicle;

a processing device configured to receive audio content and transmit an audio signal to the first loudspeaker dependent upon the audio content;

a microphone disposed within the passenger compartment and configured to:

convert the sound from the first loudspeaker and the noise within the passenger compartment into a microphone signal; and transmit the microphone signal to the processing device, wherein the processing device modifies the audio signal such that the audio signal attenuates the noise in the passenger compartment;

a second loudspeaker; and a vehicle processor configured to:

receive an external signal from a source external to the vehicle engine, the external signal being dependent upon actual dynamic vehicle operational parameter values; and transmit a simulated noise signal to the second loudspeaker for use in testing effectiveness of the active noise control arrangement in attenuating noise when the engine and/or powertrain is not running and not producing noise, the simulated noise signal being dependent upon the external signal.

16. The vehicle of claim 15 wherein the processing device is configured to receive the external signal and modify the audio signal dependent upon the external signal.

17. The vehicle of claim 15 wherein the processing device is configured to receive the audio data from an audio source that is permanently installed in the vehicle.

18. The vehicle of claim 17 wherein the audio source comprises a radio or a compact disc player.

19. The vehicle of claim 15 wherein the processing device is configured to receive the audio data from an audio source that is brought into the vehicle.

20. The vehicle of claim 19 wherein the audio source comprises a personal media device.

* * * * *